US005626297A

United States Patent [19]

Carlsmith et al.

[11] Patent Number: 5,626,297

[45] Date of Patent: May 6, 1997

[54] WOOD PULP OZONE BLEACHING CONTACTOR

[75] Inventors: Lawrence A. Carlsmith, Amherst; A. Sean Vote; Oscar Luthi, both of Nashua; Anthony G. Abdulmassih, Hudson, all of N.H.

[73] Assignee: Beloit Technologies, Inc., Wilmington, Del.

[21] Appl. No.: 491,351

[22] Filed: Jun. 30, 1995

Related U.S. Application Data

[62] Division of Ser. No. 125,053, Sep. 21, 1993.

[51] Int. Cl.[6] ..... B02C 19/12

[52] U.S. Cl. ..... 241/57; 241/188.1

[58] Field of Search ..... 241/57, 188.1, 241/247

[56] References Cited

U.S. PATENT DOCUMENTS

| | | | |
|---|---|---|---|
| 1,827,710 | 10/1931 | Leyst-Kuchenmeister | 162/57 |
| 2,723,194 | 11/1955 | Birdseye | 162/17 |
| 3,579,717 | 5/1971 | Middlebrooks | 241/188.1 |
| 3,630,828 | 12/1971 | Liebergott et al. . | |
| 3,725,193 | 4/1973 | DeMotigny et al. | 241/188.1 X |
| 3,917,176 | 11/1975 | Carlsmith . | |
| 4,080,249 | 3/1978 | Kempf et al. . | |
| 4,278,496 | 7/1981 | Fritzvold . | |
| 4,279,694 | 7/1981 | Fritzvold et al. . | |
| 4,283,251 | 8/1981 | Singh . | |
| 4,298,426 | 11/1981 | Torregrossa et al. . | |
| 4,303,470 | 12/1981 | Meredith et al. . | |
| 4,426,256 | 1/1984 | Johnsen . | |
| 4,464,320 | 8/1984 | Steffens | 241/160 |
| 4,468,286 | 8/1984 | Johnsen . | |
| 4,729,516 | 3/1988 | Williams, Jr. . | |
| 4,744,722 | 5/1988 | Sampi et al. . | |
| 5,174,861 | 12/1992 | White et al. . | |
| 5,181,989 | 1/1993 | White et al. . | |
| 5,188,708 | 2/1993 | Griggs et al. . | |
| 5,198,075 | 3/1993 | Bruniere et al. | 162/67 |
| 5,277,371 | 1/1994 | Bowns et al. | 241/154 |
| 5,364,038 | 11/1994 | Prew | 241/189.1 |

*Primary Examiner*—John M. Husar

*Attorney, Agent, or Firm*—Dirk J. Veneman; Raymond W. Campbell

[57] ABSTRACT

An apparatus produces elongate multi-fiber particles of extremely small size to facilitate substantially complete penetration of high consistency pulp fibers by ozone when exposed thereto. A housing is provided having first and second ends and a substantially smooth interior housing surface. A means is provided for introducing high consistency wood pulp into the housing. A source of ozone gas bleaches the high consistency pulp within the housing. A pin rotor is rotatably mounted within the housing, and includes a plurality of pins, each pin having a pin tip. A means is provided means for limiting the build up of high consistency pulp fiber accretions on the pin tips.

11 Claims, 8 Drawing Sheets

WOOD PULP OZONE BLEACHING CONTACTOR

This is a division of application Ser. No. 08/125,053 filed Sep. 21, 1993 now pending.

BACKGROUND OF THE INVENTION

This invention relates generally to pulp manufacturing processes and equipment, and more particularly to an apparatus and method for fluffing high consistency pulp and for promoting intimate contact between high consistency pulp and a gaseous bleaching reagent.

As is known, wood pulp is obtained from the digestion of wood chips, from repulping recycled paper, or from other sources and is commonly processed in pulp and paper mills in slurry form in water. Recently there have been many efforts to use ozone as a bleaching agent for high consistency wood pulp, and other lignocellulosic materials, to avoid the use of chlorine in such bleaching processes. Although ozone may initially appear to be an ideal material for bleaching lignocellulosic materials, the exceptional oxidative properties of ozone and its relatively high cost have limited the development of satisfactory devices and processes for ozone bleaching of lignocellulosic materials.

As used herein, the term consistency is used to express the measured ratio of dry pulp fibers to water, or more specifically, the weight of dry pulp fibers in a given weight of pulp slurry or "pulp stock", as a percentage. Various definitions are used, such as air-dry consistency (a.d. %), or oven-dry consistency (o.d. %) or moisture-free consistency (m.f. %). The laboratory techniques for measuring these values can be found in references well known in the art, such as, for example the TAPPI Standards Manual. Terms widely used to describe ranges of stock consistency useful in pulp and paper plants follow:

Low Consistency—Below about 4–6% o.d.

Medium Consistency—About 9–18% o.d.

High Consistency—Above about 18–20% o.d., but more commonly above about 25% o.d.

The primary characteristic of pulp slurries which changes with the consistency of the slurry is the fluidity. Wood pulp in the high consistency ranges does not have a slurry like character, but is better described as a damp, fibrous solid mass. High consistency pulp has an additional characteristic which is that it can be fluffed, in the same way that dry fibrous solids such as cotton or feathers can be fluffed, to give the pulp a light and porous mass, the inner fibers of which are accessible to a chemical reagent in gaseous form. In general, high consistency pulp can not be pumped in pipelines because the pipe wall friction is very high, resulting in uneconomic pumping power requirements. In the specialized case of feeding a gaseous bleaching reactor, such as ozone, it has proved practical to feed high consistency pulp wood with a screw through a short length of pipe to form an impervious plug for sealing against loss of gas.

When fluffed with a fluffing machine, such as a high consistency refiner or a pin mill for example, the high consistency fluffed pulp form a fragile fibrous mass of highly variable bulk density, the latter depending on how it is handled at the discharge of the fluffer. If for example, it is discharged into a shallow bin onto a floor, it will form a pile of fluffed pulp, and if the accumulated pile of fluffed pulp is allowed to build up to a height of about 10 feet, the weight of the pulp is sufficient to compress the fluffed pulp at the bottom of the pile to thereby reduce the gas volume within the fluffed pulp. This characteristic of compressibility of fluffed pulp makes it difficult to move or to transport fluffed pulp in conventional solids bulk handling equipment without increasing the bulk density and reducing the porosity (void volume), which has major implications in equipment for gaseous bleaching.

It is known that to realize fully the advantages of the gas phase reaction in a multi-stage bleaching of cellulosic fibrous pulp, the comminution of the pulp to produce the fluffed pulp must be of a specific nature so as to produce fragments which independent of their size are of low density, and of porous structure throughout and substantially free from any highly compressed portions, i.e. compacted fibre bundles. Only when this form of comminuted pulp is achieved can the gaseous reactants reach all parts of the comminuted pulp fragments, and thus ensure that the reaction of the gaseous reagent with the fluffed pulp proceeds rapidly and uniformly. The concern for uniformity of contact between the fluffed pulp and the bleaching reagent gas, in the case of ozone bleaching, is fostered by the rapid reduction in the concentration of ozone gas in contact with the fluffed pulp. This reduction is attributable to the extremely fast reaction rate of ozone with wood pulp. Since the reaction rate is concentration dependent, this characteristic increases the non-uniform bleaching results attendant upon the variable permeability of the pulp.

As described hereinabove, the fluffed pulp mass is easily compressed by the action of bulk solids handling equipment to form wads and clumps having much higher density and much lower gas permeability. Bleaching gas flows much more slowly through such wads and clumps and much more rapidly through the wad-to-wad contact areas. The result is overbleached contact areas and underbleached wad cores. Thus, it has been found that bleaching systems which employ conventional bulk materials handling equipment to move the fluffed pulp through a bleaching retention chamber while bleaching it with ozone gas cannot successfully produce uniformly bleached pulp fluff.

Pin shredders and fluffers are used in pulp and paper manufacture and in many other industries for shredding sheet material or fluffing fibrous materials. Typically, in these machines, a sheet of wood pulp at a consistency of about 15–50% is received in a radially inward direction by a pin roll which is equipped with an array of small pins which tear off small particles of pulp and fling them down into a collecting conveyor or chute for further processing. The size of the particle produced by such a pin shredder depends on the size and spacing of the pins and the speed of rotation.

When a very fine particle of pulp is desired, as for example in the flash drying of wood pulp or in gas phase high consistency bleaching, machines have been tried which enclose a pin rotor in a housing, except for a feed chute and a discharge opening. An example of such a machine is a fluffer used in high consistency bleaching experiments, and which is described in U.S. Pat. No. 3,725,193 to De Montigny. This machine includes a chute at the top of a cylindrical housing which encloses a pin rotor. Bulk pulp is fed to the machine through the chute. The bulk pulp is ripped apart on coming in contact with the pins of the pin rotor. The bulk pulp is further reduced in particle size as it is carried repeatedly around the interior of the housing. This machine is also equipped with slots or a screen at a housing bottom which permit sufficiently small particles or individual fibers to be discharged, but retain larger particles for further defibration. However, while this machine, and other similar machines, may have operated with varying degrees of success, these machines suffer from a plurality of shortcomings which have detracted from their usefulness.

For example, a disadvantage of using a screen to retain the coarse particles within the housing arises from the fibrous and floccular nature of moist wood pulp. More particularly, with softwood or coniferous wood pulps, whose fibers may average 2.5–3.5 millimeters in length, there is a strong tendency for the fibers which have been separated to aggregate into clumps commonly called flocs, and which may be much larger than the fibers themselves. For the flocs to pass through the screen, the apertures or slots must be undesirably large, which will result in permitting unfluffed particles of similar size to pass.

Another disadvantage of present pin rotors for use in fine fluffing moist wood pulp is the tendency of fibers to collect on the tips of the pins and adhere to the pins, thereby forming a lump of wood pulp which effectively enlarges the size of the pin at the tip. Such a lumping of wood pulp prevents the small pin tip from tearing away small pieces of pulp. Additionally, such lumping of wood pulp at a pin rotor tip leads to bridging between adjacent pins and may produce a jamming action which can bend the pins or stall the rotor. As a result, these machines have proven to be useful only when charged with a small amount of wood pulp and confined to laboratory use. More particularly, experimentation has shown that charges of pulp in excess of about 30 grams of high consistency wood pulp will cause sufficient bridging to create a frictional drag in the machine housing of sufficient magnitude to bend the individual pins.

In addition to the foregoing, and in present pin rotor machines for operation in the high speed range for processing high consistency wood pulp, typically the present high speed pin rotor machines are equipped both with rotating pins disposed on the rotor and stationary pins disposed on the interior housing wall. Such high speed pin rotor machines have operated with varying degrees of success in the low to medium consistency ranges for processing wood pulp. However, these high speed pin rotor machines are replete with shortcomings which have detracted from their usefulness in processing high consistency wood pulp. For example, theses machines experience severe plugging during operation by operation of the wood pulp fibers wrapping against the stationary pins and being trapped thereon by the centrifugal force of the operating machine.

The foregoing illustrates limitations known to exist in present machines for fluffing and manipulating high consistency wood pulp. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus for producing elongate multi-fiber particles of extremely small size to facilitate substantially complete penetration of high consistency pulp fibers by ozone when exposed thereto. The apparatus includes a housing having first and second ends and a substantially smooth interior housing surface. A conveying means is provided for introducing high consistency pulp into the housing. A source of ozone gas bleaches the high consistency pulp within the housing. A pin rotor is rotatably mounted within the housing, and the pin rotor includes a plurality of pins, each pin having a pin tip. A limiting means limits the build up of high consistency pulp fiber accretions on the pin tips.

Also, in accordance with the present invention, a method is provided for optimizing the reaction between a gaseous bleaching reagent and a volume of high consistency wood pulp. The method comprises the steps of conveying fluffed high consistency pulp to a vertically oriented conically shaped contactor; rotating a pin rotor within the contactor at a predetermined velocity; and accelerating the fluffed wood pulp within the contactor, by action of the rotating pin rotor, to a predetermined tangential velocity which is of sufficient magnitude to retard pulp movement downwardly within the contactor.

The foregoing and other aspects will become apparent from the following detailed description of the invention when considered in conjunction with the accompanying drawing figures.

BRIEF DESCRIPTION OF THE DRAWING FIGURES

Figure 1:
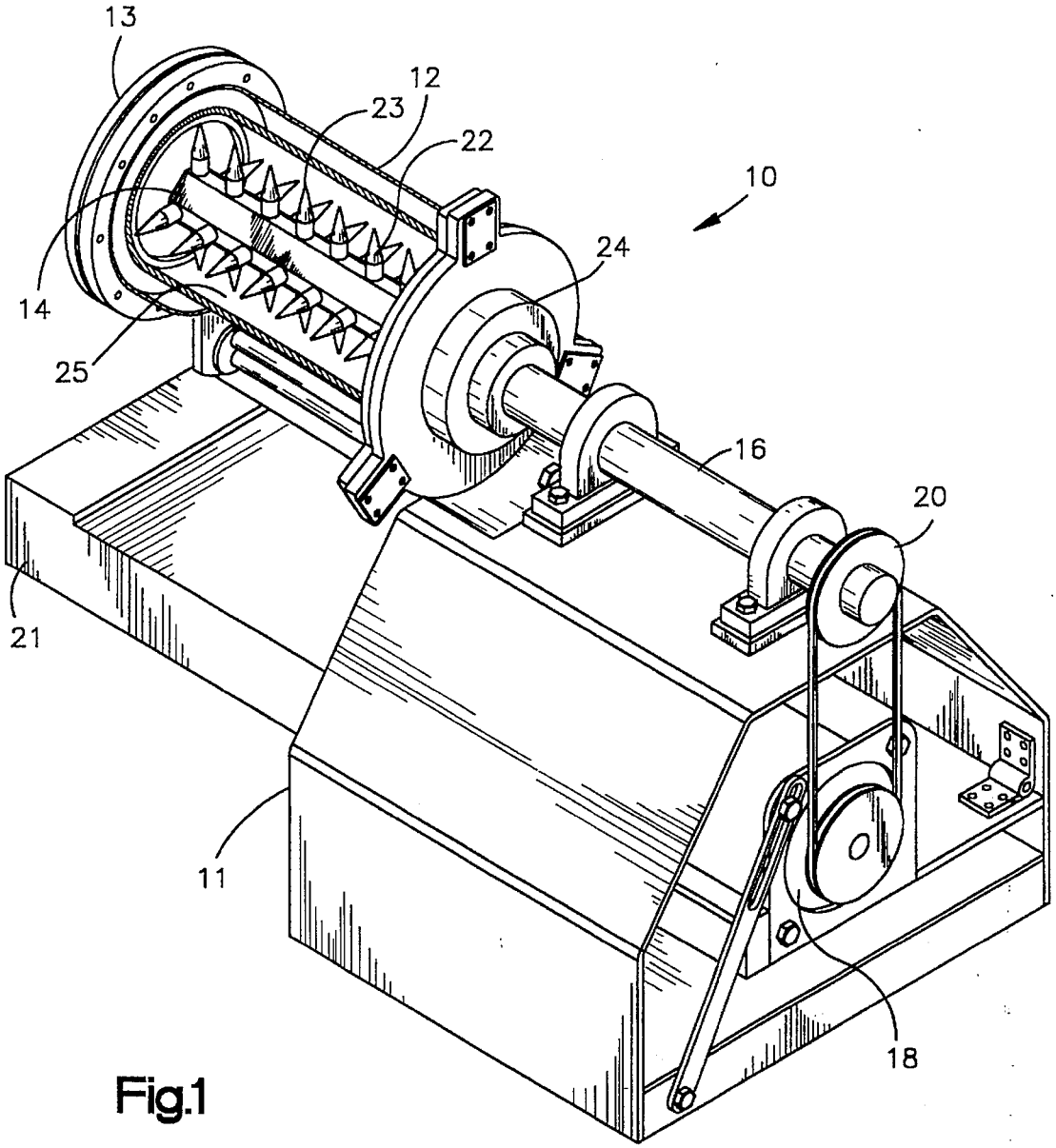
FIG. 1 is a perspective view of a prototype, laboratory scale, batch version of the apparatus of the present invention, and wherein an apparatus housing is illustrated in section to expose a pin rotor rotatably mounted therein.
Figure 8:
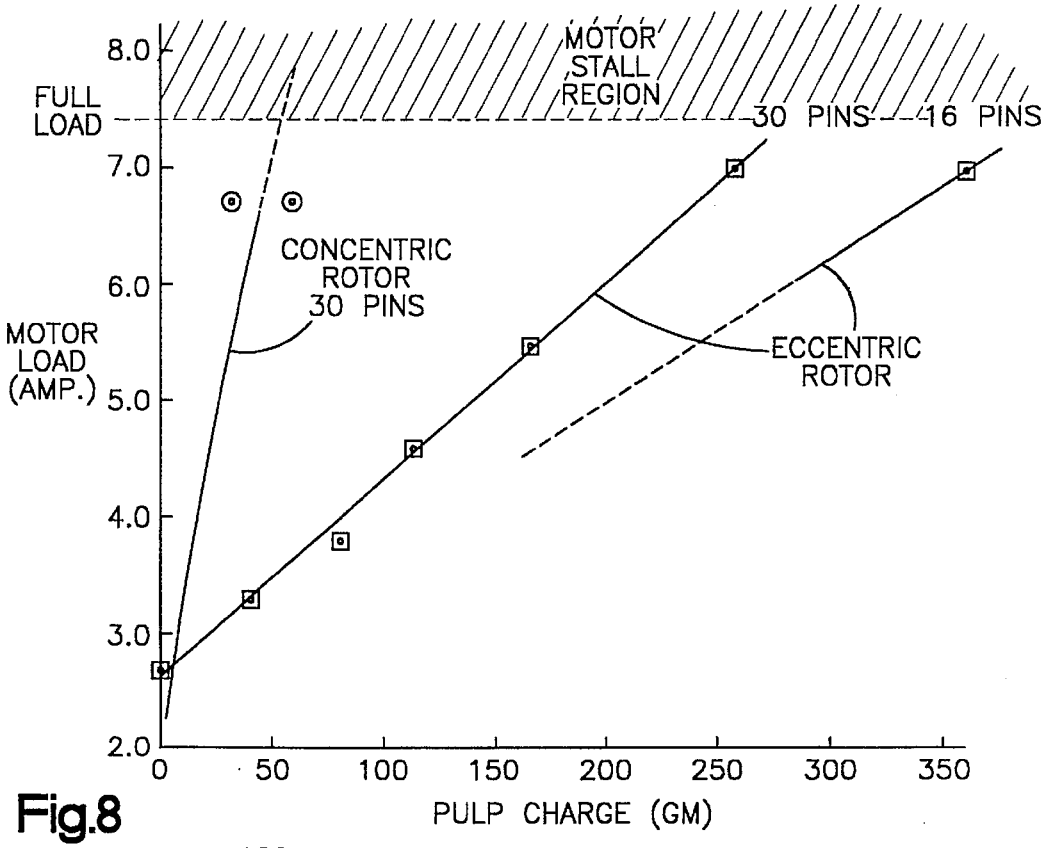

FIG. 8 graphically represents the results of laboratory scale experiments directed to the apparatus of FIG. 1.

Figure 9:
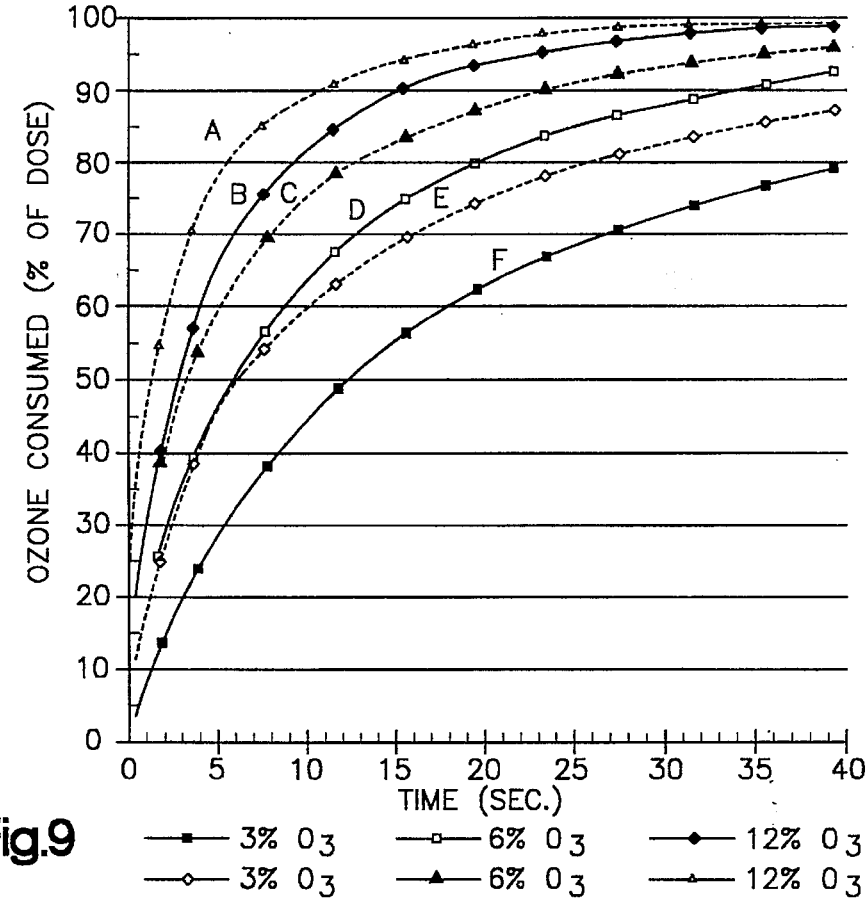

FIG. 9 graphically represents the results of a computer generated model wherein a predetermined percentage of ozone consumed in a gaseous bleaching process is plotted with respect to the time of its consumption.

DETAILED DESCRIPTION

Referring now to the drawings, wherein similar reference characters designate corresponding parts throughout the several views, an apparatus is shown at 10 for fluffing high consistency pulp and for promoting intimate contact between high consistency pulp and a gaseous bleaching reagent. Apparatus 10 is capable of producing elongate multi-fiber particles of extremely small size having a length of about three times the absolute length of the individual fibers and a diameter of about ½ to ⅓ the individual fiber length to provide better access for a reactant gas to the lignin in the fibers.

The apparatus 10 illustrated in FIG. 1 is an embodiment of a small, laboratory scale, batch version of the present invention which includes a housing 12 having a cover 13 and a pin rotor 14 which is rotatably mounted in the housing. During laboratory use, the apparatus 10 is charged with a predetermined volume of high consistency wood pulp by removing the housing cover 13. A gaseous bleaching reagent, such as an ozone/carrier gas mixture, enters the housing 12 through a gas inlet port, (not shown). The apparatus 10 is mounted for operation on a base assembly 11. The pin rotor 14 has a shaft 16 which is driven by a conventional prime mover 18 and a drive assembly 20, such as an electric motor and a conventional V-belt pulley assembly for example. A receiving vessel 21 receives processed pulp from a discharge (not shown). A seal assembly 24 seals the housing 12 from gas leakage at the entry of shaft 16 into the housing.

The pin rotor 14 has a plurality of pins 22, each having a pin tip 23. The pins 22 are fixedly mounted on the pin rotor 14, and arranged in a predetermined number of staggered rows. For example, a first row of pins may be positioned in a plane normal to the axis, at 12:00, 3:00, 6:00 & 9:00 o'clock. An adjacent row of pins may be located about 1 inch away axially, but the orientation of the pins is rotated 45°, or at 1:30, 4:30, 7:30 and 10:30 o'clock. The next set is oriented back at 12:00, and so forth. The result is that the pins in one axial row are about from 1¾ to 2 inches apart, but the pulp is "combed" by teeth on a 1 inch spacing. The predetermined number of staggered rows are arranged about the circumference of the pin rotor in such a fashion that the spacing between the tips of any two pin tips in adjacent rows is one half the distance of the spaced interval between any two pin tips in the same row. For example, if the pin spacing of the pins of an individual row is 1¾ inches, the spacing between a first pin of a first row and a first pin of an adjacent second row is about 0.87 inch.

The pins 22 may be tapered in their shape, or conically shaped to facilitate discharging pulp accretions therefrom, which will be described in further detail hereinafter. Additionally, the pins 22 may be biasedly mounted on the pin rotor 14.

Figure 4:
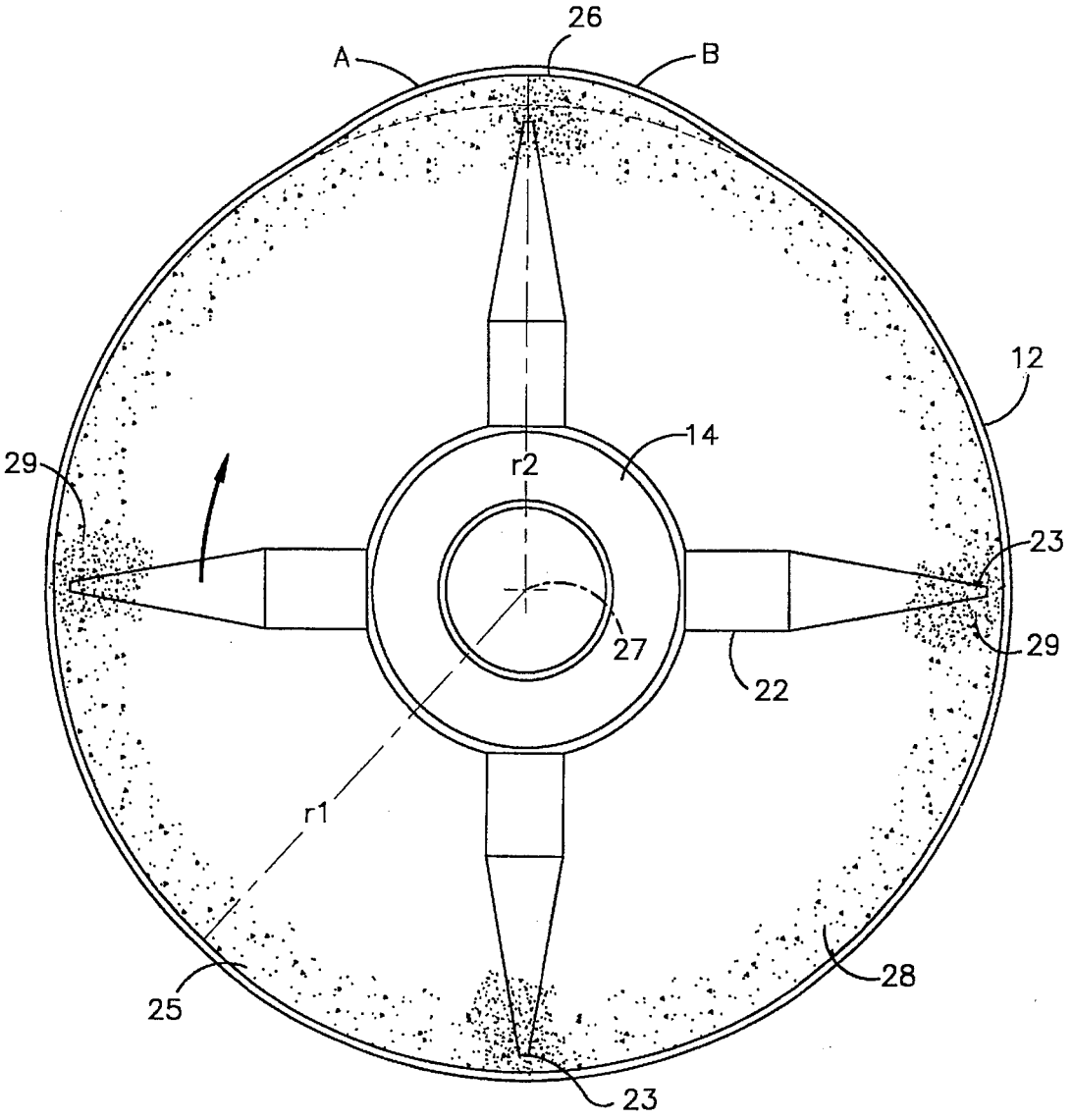
FIG. 4 is an end, sectional view illustrating one possible embodiment of the apparatus of FIGS. 1, 2, and 3, illustrating longitudinally disposed relief chamber formed in the housing.

As best illustrated by FIG. 4, the housing 12 defines a generally smooth interior surface 25 upon which an annulus 28 of high consistency wood pulp forms during operation of the apparatus 10. The pin tips 23 rotate in close proximity to the interior surface 25 at a clearance of about ⅛ to ¼ inch. In one portion of the interior surface of the housing 12, a relief chamber 26 is formed. In this regard, the pin rotor shaft 16 rotates about a central axis 27. The smooth interior surface 25 defines a first portion and a second portion. The first interior surface portion of the housing 12 defines a constant distance r1 from the axis 27 extending from a predetermined point B on the interior housing surface 25, clockwise, to a predetermined point A. The second interior surface portion defines a variable distance r2 from the predetermined point A, clockwise, to the point B, r2 being greater than r1 throughout a predetermined distance on the interior surface 25 until the point B at which r1 equals r2. The relief chamber 26 is defined by the second interior surface portion of the interior housing surface 25, and the relief chamber 26 extends longitudinally along the entire length of the housing 12.

As seen in FIG. 4, the housing 12 is generally concentric about the pin rotor 14. The internal geometry of the housing, as described hereinabove, permits fiber acretions 29, which form on the pin tips 23, to be thrown off the pins 22 into the relief chamber 26 to be swept away by the rotating annulus of pulp 28. During rotation of the pin rotor 14, the pin tips 23 diverge from the interior housing surface 25 at the relief chamber 26 so that the clearance between an individual pin tip 23 and the interior housing surface increases to about ⅜ to ⅝ inch, and then the individual pin tips reconverge to the smaller clearance during rotation through the first portion of the interior housing surface 25. The annulus of high consistency wood pulp 28 is combed by the pin tips 23 to defiber matted particles of pulp received from a preceding dewatering and pressing device, thereby producing a generally circumferential alignment of the fibers.

The high consistency wood pulp is rotated by the action of the rotating pins 22. As should be understood, a centrifugal force is generated by the pin rotor 14 rotating at a velocity v1, which causes the high consistency wood pulp within the housing 12 to form the annulus 28, and which causes the annulus 28 to rotate against the interior housing surface 25. By virtue of the centrifugal force, the rotating annulus of high consistency wood pulp experiences a frictional drag on the surface 25 such that the annulus 28 rotates at a velocity v2, which is less than the velocity v1, which thereby establishes a differential velocity v3 between the pins and the pulp which results in a combing action between the pin tips 23 and the annulus of high consistency wood pulp 28.

Figure 2:
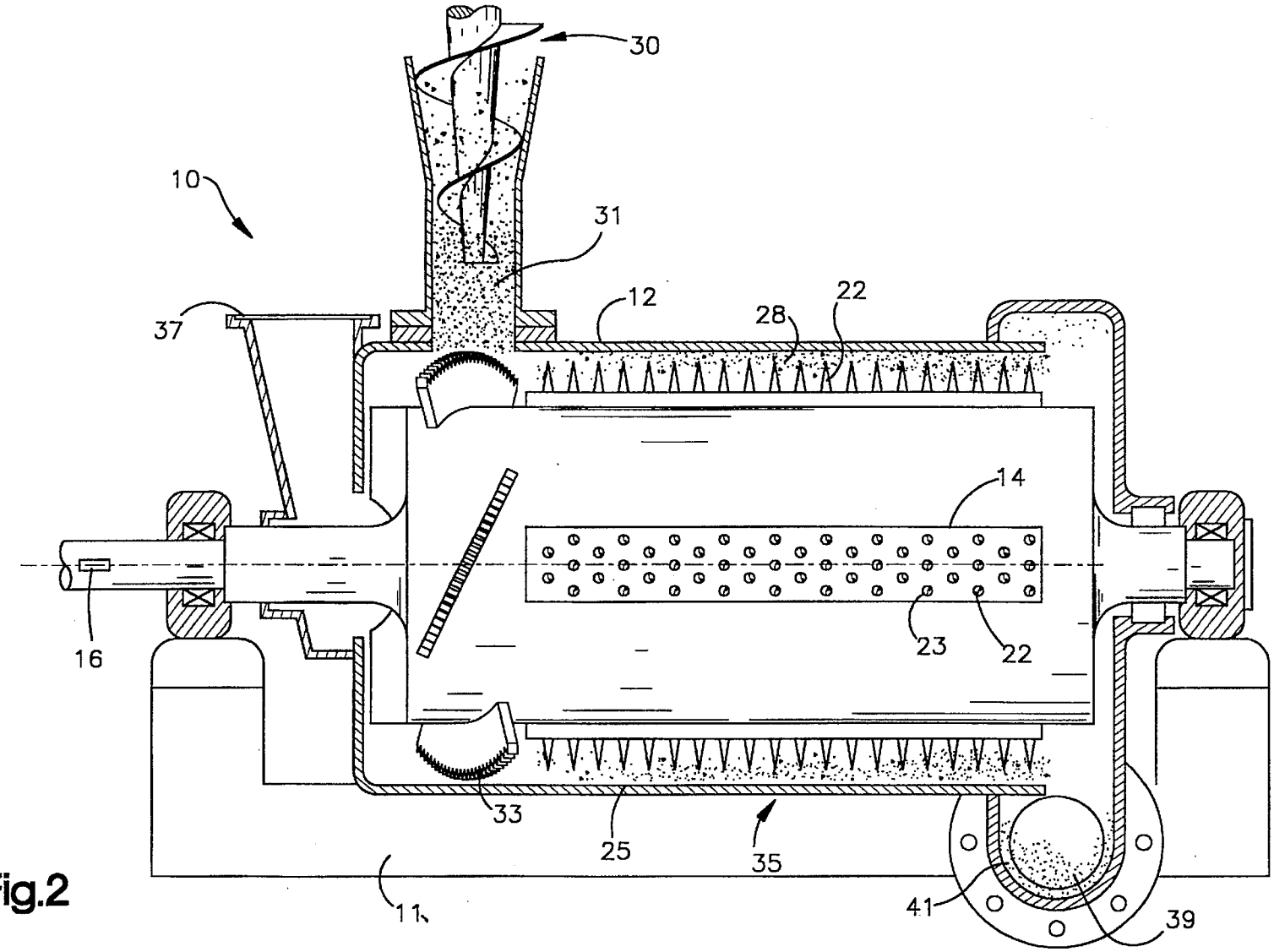
FIG. 2 is a cross-sectional view of an embodiment of the apparatus of the present invention wherein the apparatus is supported at each end thereof by a support assembly.

FIG. 2 illustrates a contemplated commercial embodiment of the apparatus 10 which is designed for continuously fluffing a high volume of high consistency wood pulp and for continuously promoting intimate contact between the high consistency pulp and a gaseous bleaching reagent. The housing 12 receives a continuous stream of high consistency wood pulp from a feeding and gas seal forming assembly device 30 which compacts the high consistency wood pulp into a gas tight plug 31. The pin rotor shaft 16 carries pulp shredding elements 33 which break the plug 31 into small pieces, and convey them into a fluffing and contacting zone of the housing 12, which is generally indicated by the numeral 35. The shredding elements 33 also impart an initial circumferential velocity to the pulp particles. The pin tips 23 comb through the annulus 28 of pulp which forms against the interior housing surface 25.

During operation of the apparatus 10 of FIG. 2, the annulus of nigh consistency wood pulp moves axially through the housing 12 which may be accomplished by a variety of techniques. For example, axial movement of the annulus of pulp may be achieved and controlled by: 1) using the flow of a gaseous bleaching chemical to blow the fluffed pulp through the housing 12; 2) using spiral guide vanes on the inside of the housing 12 to move the rotating layer of pulp toward a pulp discharge; 3) proportioning the apparatus 10 such that the natural centrifugal gradient of fluidized fluffed pulp will impart adequate axial velocity; and 4) positioning the pins 22 in a spiral pattern on the rotor, or by shaping the pins 22 with a slight non-symmetrical bias so as to produce a conveying action on the pulp.

The apparatus of FIG. 2 additionally includes a gaseous bleaching reagent inlet 37 and a spent gas outlet 39 which permit an introduction of chemicals for pulp treatment in the housing 12 in a cocurrent sense, that is, the chemicals are introduced with the untreated pulp and move in the same direction. The partially spent chemicals may be discharged with the pulp through a discharge zone 41.

Figure 3:
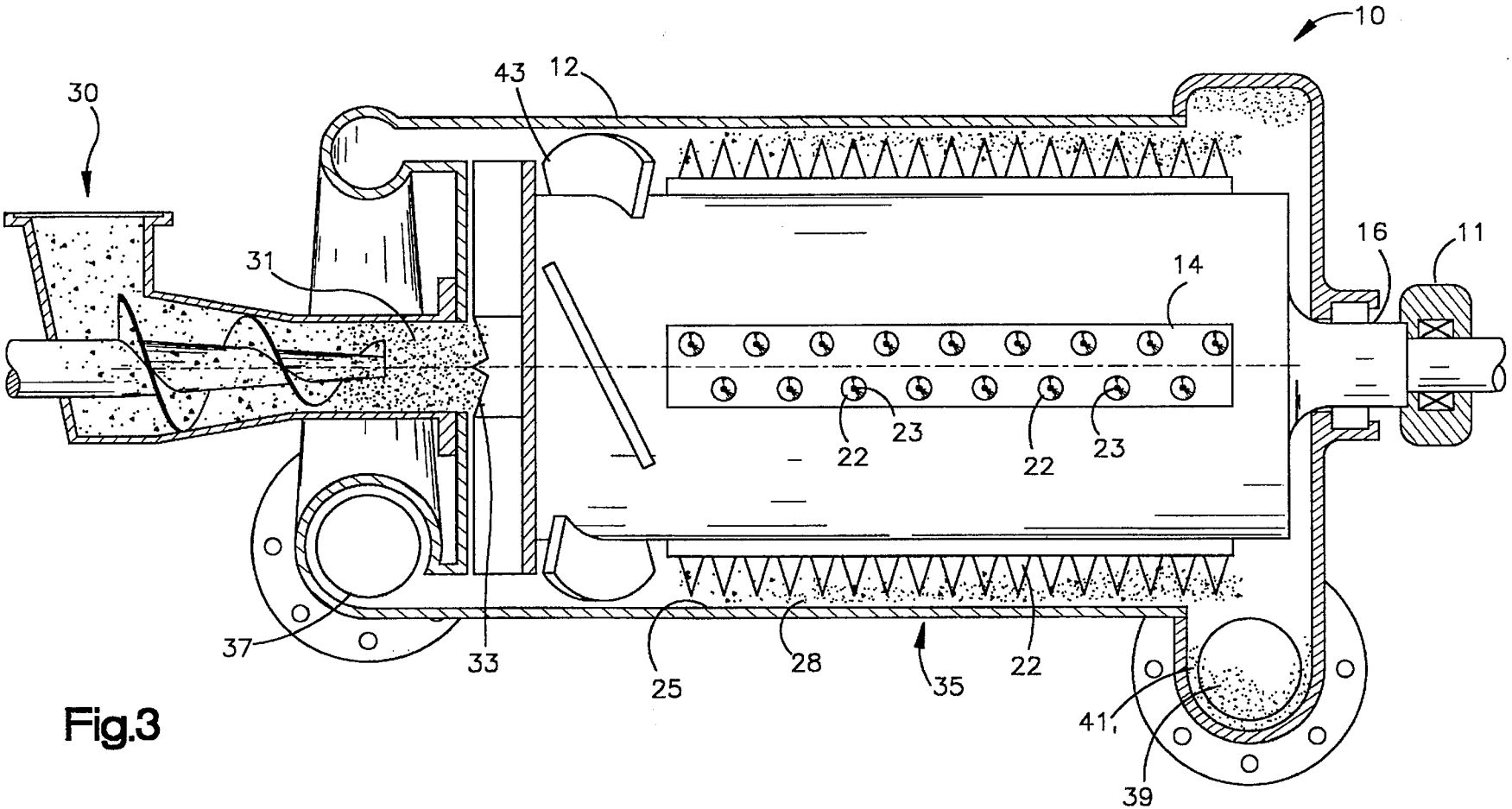
FIG. 3 is a cross-sectional view of an embodiment of the apparatus of the present invention, similar to FIG. 2, wherein the apparatus is supported only at one end thereof.

FIG. 3 illustrates a modified version of the commercial embodiment of the apparatus 10 which is illustrated in FIG. 2, but which is mounted in a cantilevered configuration, and which includes a feeding and gas seal forming assembly device 30 which is oriented along the major axis of the apparatus 10, instead of being disposed generally transverse to the major axis. The pulp shredding element 33 is mounted in an end configuration on a bladed fan assembly 43 which provides a motive force to the high consistency wood pulp to assist in transporting the high consistency wood pulp particles into the contact with the pin tips 23.

Figure 5:
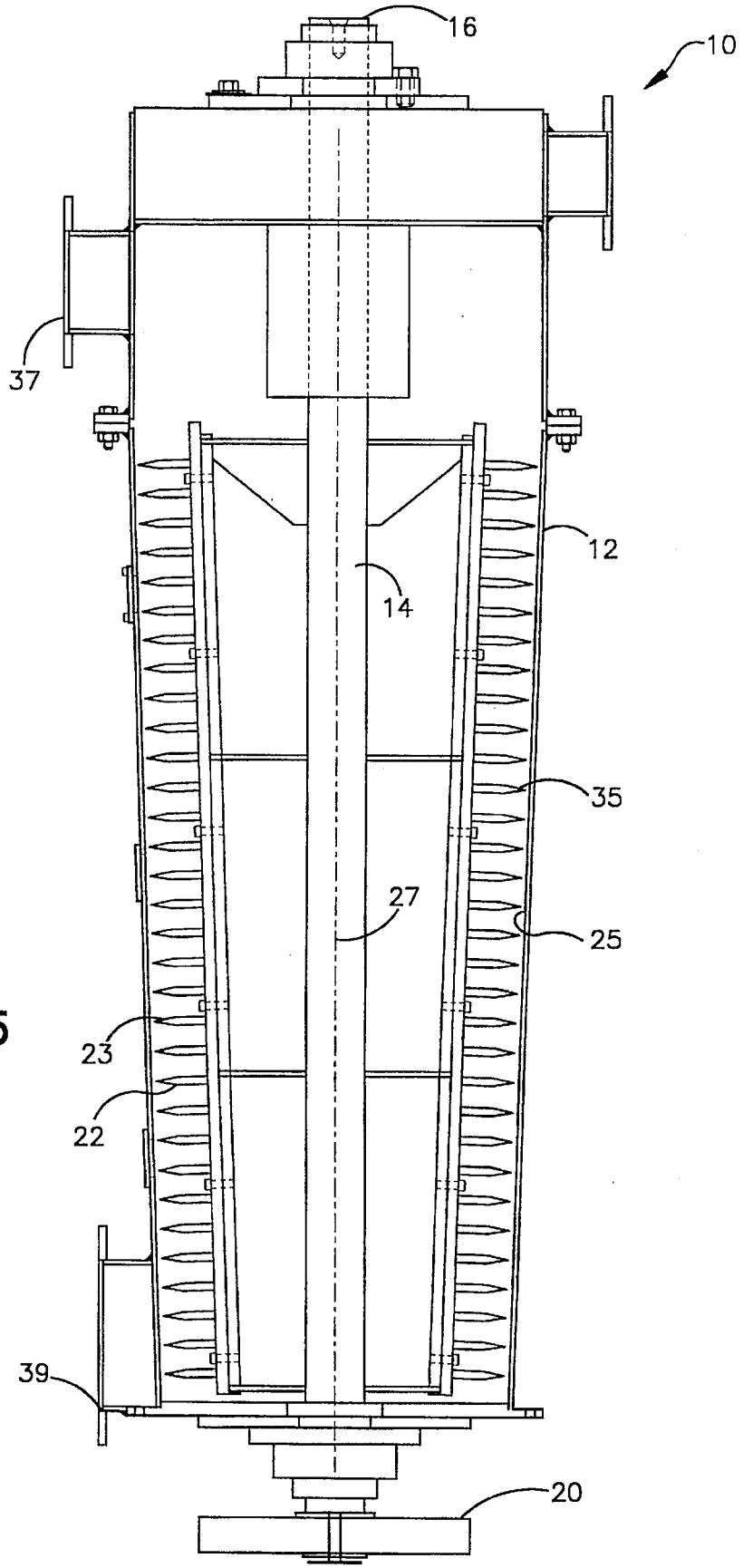
FIG. 5 is a cross-sectional view of an embodiment of the apparatus of the present invention wherein the apparatus is vertically oriented in a wood pulp bleaching system, and includes a frusto-conically shaped housing having a conformably dimensioned rotor assembly mounted therein.
Figure 6B:
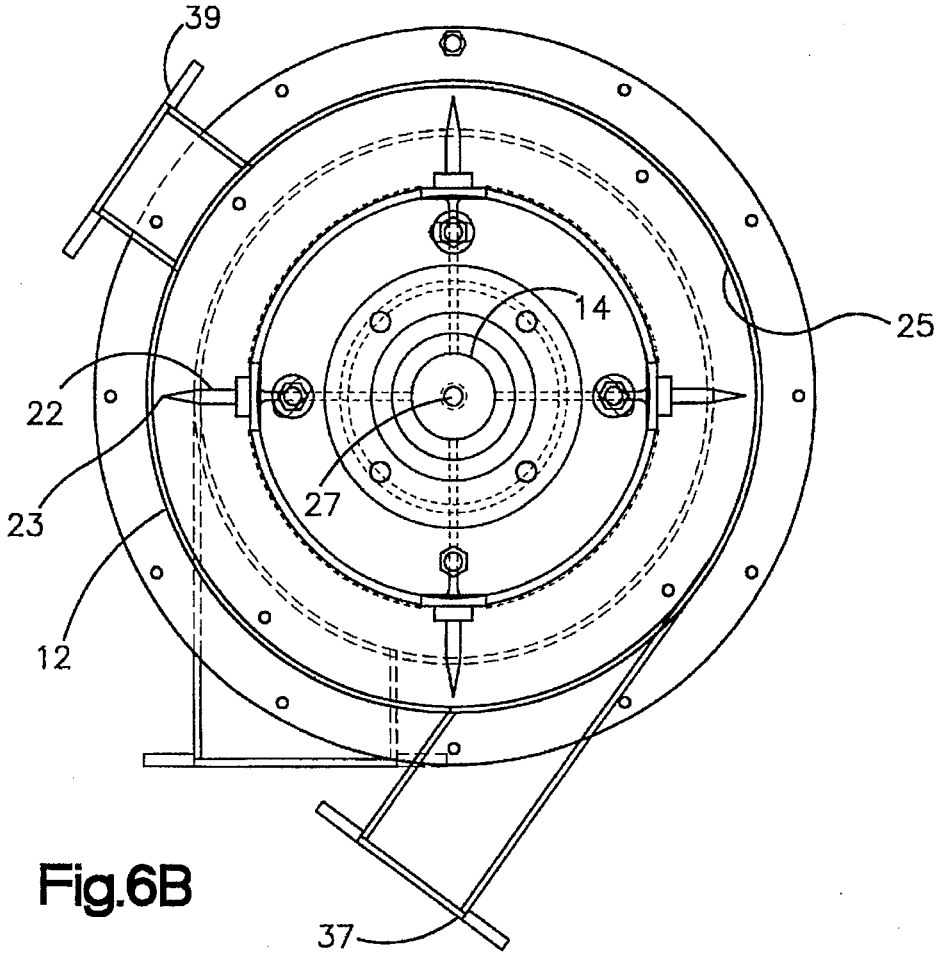
FIG. 6B is an end, sectional view of the apparatus of FIG. 5 illustrating the rotor in an concentrically mounted position.
Figure 6A:
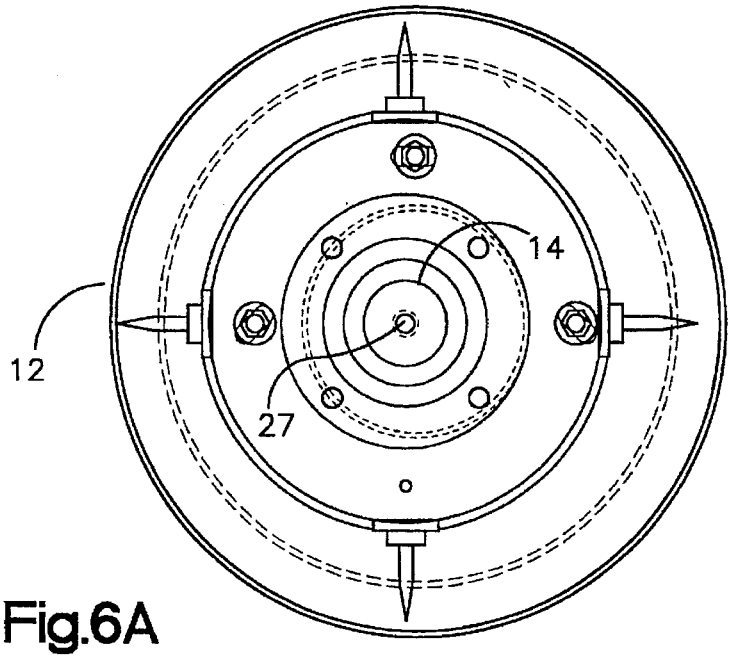
FIG. 6A is an end, sectional view of the apparatus of FIG. 5 illustrating the rotor in an eccentrically mounted position.

FIG. 5 illustrates a third embodiment of the apparatus 10 which is generally vertically mounted for operation in a wood pulp processing system (not shown). The apparatus of FIG. 5 includes a generally conically shaped housing 12 having an interior surface 25 which defines a constant distance r1 at any predetermined point along central axis 27 in a plane perpendicular to the central axis. In this embodiment, the pin rotor 14 is mounted eccentrically within housing 12 such that there is a close clearance on one side of the housing, and a large clearance on the opposite side, thereby creating the relief chamber 26 which functions as described hereinabove. As should be understood, the pin rotor 14 may by adjustably mounted in housing 12 to provide a relief chamber having a range of dimensions. More particularly, the pin rotor 14 may be mounted such that it is adjustably rotatably mounted within the housing 12 from a first mounting position wherein the pin rotor is concentric with respect to the interior housing surface 25 as illustrated in FIG. 6B, through a range of mounting positions to a second mounting position wherein the pin rotor is mounted in an extreme eccentric position with respect to the interior housing surface 25 as illustrated in FIG. 6A. As should be understood, numerous other variations of the geometry of the relief chamber can be used in place of those described hereinabove, such as an elliptical housing or an obround housing providing two relief chambers.

Figure 7:
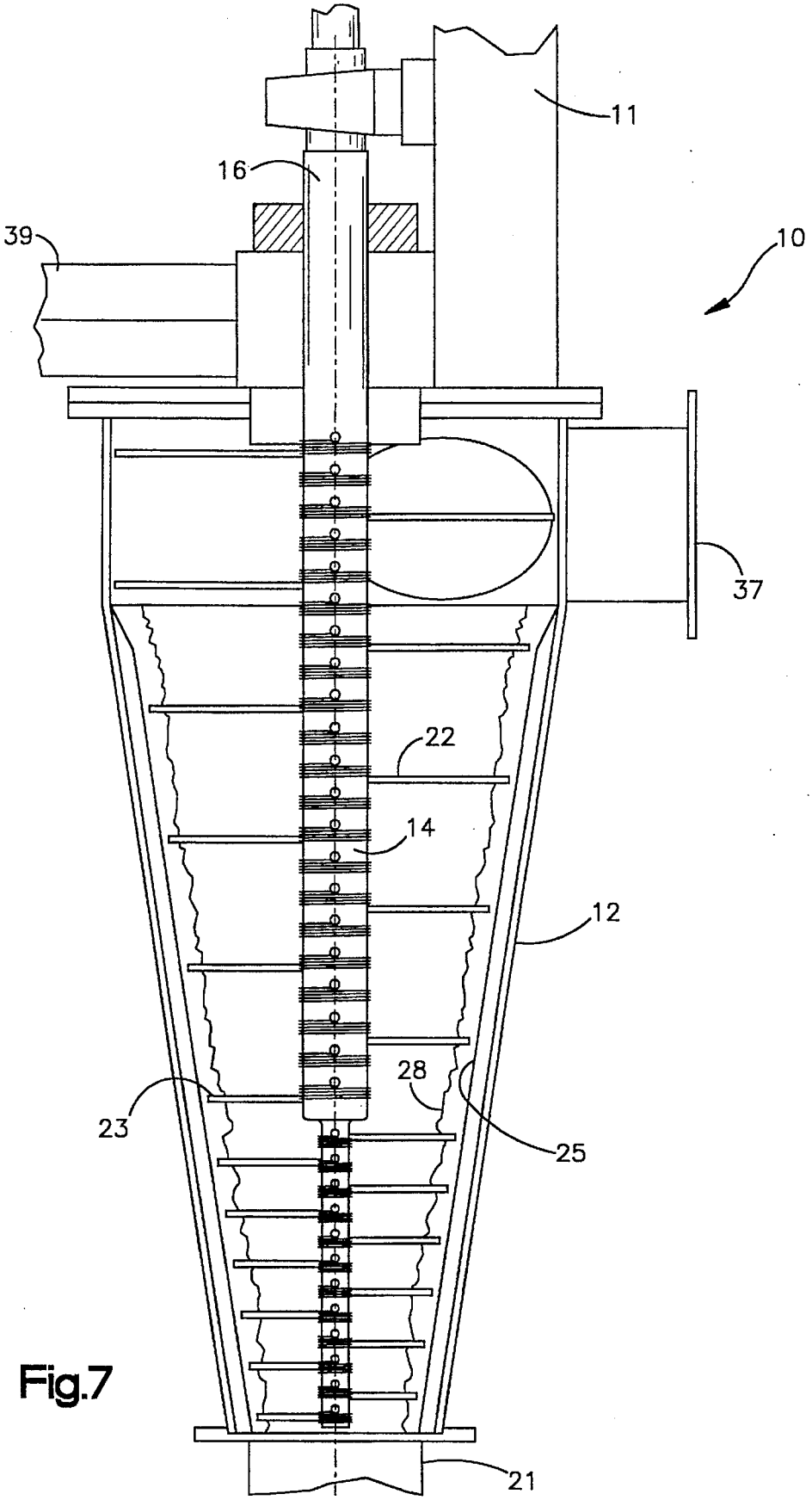
FIG. 7 is a cross-sectional view of an embodiment of the apparatus of the present invention wherein the apparatus includes a frusto-conically shaped housing, and a rotor having a plurality of pins biasedly mounted thereon.

The apparatus 10 of FIG. 5 may be used as a flail type vertical contactor in a gaseous bleaching process. When used in such a configuration, the pin rotor 14 may be concentrically mounted within the housing 12. Generally, vertical contactors are not effective in a gaseous bleaching process because the high consistency pulp tends to fall through the vertical housing at a faster rate than desired to achieve effective bleaching. To overcome this shortcoming, it has been discovered that if the housing 12 is frusto-conically shaped, with converging interior wall surfaces 25, and the pin rotor 14 is rotated at a predetermined high velocity, the wood pulp is contained within the contactor for a longer desired time period thereby achieving effective bleaching. During operation of the apparatus of FIG. 5, the high consistency wood pulp entering the housing 12 is thrown against the interior housing wall 25 and travels at high velocity in a circumferential direction around an upper housing portion. The friction of the pulp on the surface 25 quickly decelerates the pulp and the pulp begins to fall such that the pins 22 contact tile pulp. The pins 22 maintain the annular layer of pulp at a tangential velocity which is of sufficient magnitude to retard the tendency of the pulp to drop by gravity to the bottom of the housing. FIG. 7 is an embodiment of the apparatus 10 similar to FIG. 5 wherein the apparatus includes a rotor having a plurality of pins biasedly mounted within a frusto-conically shaped housing.

FIG. 8 graphically represents the results of laboratory scale experiments directed to the apparatus 10, and which will be described hereinafter.

A laboratory contactor was built of the design shown in FIG. 1. The inside dimensions of the housing 12 were 6 inches in diameter and 12 inches long. The pin rotor 14 was originally 5.75 inches in diameter and was installed concentrically within the 6 inch diameter housing, resulting in a clearance between the rotor pin tips 23 and the housing of 0.125 inch. In an initial trial it was found that not more than about 25 grams (o.d. basis) of wood pulp at 45% consistency could be agitated in the apparatus 10 at 1050 r.p.m. pin rotor speed. When a larger amount of pulp was placed in the apparatus, it would stall the 1.5 h.p. motor which was employed as the prime mover.

Thereafter, the diameter of the pin tips 23 was reduced in two steps as shown in the following table, allowing somewhat larger amounts of pulp to be run, but in all cases the motor was stalled when the machine was loaded with as much as 100 grams of pulp.

| Clearance | Pulp weight | Motor amps. (7.1 amp F.L.) | Result |
|---|---|---|---|
| 0.125 inch | >25 gm | | Stalled |
| 0.188 inch | 25 gm | 6.7 amp | Pulp circulating |
| | 50 gm | 6.7 amp | Pulp circulating |
| | 75 gm | 7.6 amp | Pulp circulating |
| | 100 gm | 33.0 amp | Stalled |
| 0.312 inch | 25 gm | 0.9 amp | Pulp circulating |
| | 50 gm | — | Stalled |
| 0.312 inch & after removing every other pin in each axial row | | | |
| | 30 gm | 2.0 amp | Pulp circulating |
| | 71 gm | 2.2 amp | Pulp circulating |
| | 100 gm | — | Stalled |

In each experiment in which the apparatus stalled, after disassembly, it was observed that the pin tips 23 were covered with a hard tuft of wood pulp fibers 29, which had built up to form a hard cap on the pin tip, and the cap had been wedging between the pin 22 and the interior of the housing 25, creating a jamming action which suddenly overloaded the motor.

The laboratory apparatus was then modified in accordance with the present invention by mounting the pin rotor 14 eccentrically in the housing, giving a minimum clearance on the closest side of 0.236 inch, and on the opposite side a maximum clearance of 0.625 inch. This created an arcuate zone of clearance, the relief chamber 26, which the fiber caps could be discharged by centrifugal force once each revolution so that the caps would be prevented from accreting to the point that they could contact the housing and create a high frictional resistance.

The apparatus 10 was then charged with successively larger amounts of wood pulp at 45% consistency, and the pin rotor operated at 1750 r.p.m. The power consumption was recorded and is presented in graphical form in FIG. 8, along with the data from the above tabulation for the case of 0.312 inch concentric clearance. It is clear from inspection of the graph that in the conventional concentric configuration the power increases abruptly to the point of jamming and stalling when small amounts of wood pulp are added. This prevents the operation of the machine at commercially desirable higher loadings. However, in the eccentric configuration of the invention, the power rises steadily and smoothly as the quantity of pulp is increased, which implies that in a commercial version for processing a continuous stream of wood pulp, the throughput may be increased to absorb the selected fluffing or contacting horsepower without risk of stalling and jamming, thereby permitting the machine to operate steadily at its design capacity.

The capacity of a commercial machine, such as that illustrated in FIGS. 2 and 3, can be easily forecasted from the laboratory batch experiment. Since the laboratory machine is running with a rotating annular layer of pulp totalling for example 350 grams (over dry basis), equivalent to about 0.77 lbs., and since the surface area of the housing is about 1.57 square feet, the design loading is about 0.5 lbs/sq. ft. In a continuous process machine, the required size may easily be calculated from this "specific wall loading", plus the desired retention time in the machine for fluffing or for chemical contacting, plus the desired throughput capacity.

Area=(time)×(capacity/specific wall loading)

FIG. 9 graphically represents the results of a computer model wherein the percentage of ozone consumed in a gaseous bleaching process is plotted with respect to the time of its consumption in a continuous concurrent reactor or contactor, such as that illustrated by FIGS. 2 and 3. [FIG. 9 assumes full concentration of ozone reacting with pulp at the start of a reaction]. FIG. 9 plots six lines A–F described as follows:

Line A represents a contactor wherein a pin rotor of the present invention is employed with an ozone concentration of 12%.

Line B represents a contactor wherein a conventional scoop paddle rotor is employed with an ozone concentration of 12%.

Line C represents a contactor wherein a pin rotor of the present invention is employed with an ozone concentration of 6%.

Line D represents a contactor wherein a conventional scoop paddle rotor is employed with an ozone concentration of 6%.

Line E represents a contactor wherein a pin rotor of the present invention is employed with an ozone concentration of 3%.

Line F represents a contactor wherein a conventional scoop paddle rotor is employed with an ozone concentration of 3%.

Regarding the graphic results of FIG. 9, laboratory observations of the pulp fluffed by the apparatus of the present invention shows that the pulp consists of elongated particles having a length from 0.25 to 0.50 inch (6.4 to 12.7 mm) and a width or diameter from 0.03 to 0.06 inch (0.8–1.6 mm). Because laboratory testing shows that ozone bleaching kinetics (reaction rate) appears to be governed by mass transfer of ozone from the gas phase to within the fibers where the lignin resides, the important dimension in an elongated particle is the short dimension. As is demonstrated by the above outlined particle sizes, the pin rotor fluffer of the present invention gives superior fluff quality which is evidenced by higher reaction rates, as shown in FIG. 9.

In addition to creating a pulp fluff with smaller particle sizes, the apparatus 10 of the present invention, when used as a gaseous bleaching contactor, by its small scale combing action on the rotating annulus of pulp, more effectively exposes the pulp to the bleaching reagent. This further improves mass transfer and allows the use of a shorter retention time, also as illustrated by FIG. 9.

In operation, the apparatus 10 fluffs high consistency wood pulp and/or may be employed as a contactor to optimize reaction between a high consistency wood pulp and a gaseous bleaching reagent. High consistency wood pulp is introduced at one end of the housing 12 to form a uniform annulus of pulp 28 of about ½ to 4 inches thick, which is distributed over the interior surface 25 of the housing so that the layer of wood pulp can be combed and fluffed by a pin rotor 14. A relief chamber is provided wherein the pin tips 23 diverge from the surface 25, and then reconverge to close clearance, such that accretions of fiber on the pin tips are thrown clear at least once per revolution of the pin rotor to avoid plugging of the spaces between the pins, or jamming of pulp accretions between the pin tips and the surface 25. The annulus of wood pulp is propelled axially through the housing by the pin rotor 14, or by other propulsion means, and is discharged at a discharge zone 41. Centrifugal force of the annulus of pulp layer produces a frictional drag on the surface 25 which slows the annulus of pulp to a rotational velocity well below that of the pin rotor, thereby permitting enabling the combing action described hereinabove. A calculation based on 75% of the power being dissipated as friction, indicates that the pulp velocity is about 40% of rotor tip speed. This means that the pin tips are passing through the pulp layer at a relative speed of 60% of tip speed.

When used as a gaseous bleaching contactor, gaseous chemicals are introduced at one end and discharged at the other, either cocurrently or countercurrently, and the combing action of the pulp layer results in improved mass transfer between the gas and the pulp fibers resulting in a substantially faster reaction rate.

While this invention has been illustrated and described in accordance with a preferred embodiment, it is recognized that variations and changes may be made therein without departing from the invention as set forth in the following claims.

Having described the invention, what is claimed is:

1. A high consistency pulp ozone bleaching contactor comprising:

a generally vertically oriented and conically shaped housing having an interior surface, a vertical axis, an inlet and an outlet, the outlet being axially separated from and lower than the inlet;

a means for introducing high consistency pulp into the housing;

a means for introducing a flow of ozone into the housing; and a combing means for combing high consistency pulp, for contacting the ozone with the high consistency pulp and for rotating the high consistency pulp about a vertical axis to form a rotating annulus of high consistency pulp adjacent the housing interior surface.

2. The contactor according to claim 1, further comprising:

a retarding means for retarding the flow of high consistency pulp from the inlet to the outlet.

3. The contactor according to claim 2 wherein the retarding means includes a pin rotor rotatably mounted within the housing, the pin rotor including a plurality of pins, the pin rotor being rotated a predetermined speed, thereby accelerating the high consistency pulp to a predetermined tangential velocity which is of sufficient magnitude to retard pulp movement downwardly within the contactor.

4. The contactor according to claim 1 wherein the combing means includes a pin rotor rotatably mounted within the housing, the pin rotor including a plurality of pins, each pin having a pin tip.

5. The contactor according to claim 4, further comprising:

a relief means for limiting the build up of high consistency pulp fiber accretions on the pin tips.

6. The contactor according to claim 5 wherein the relief means comprises the pin rotor being eccentrically mounted within the housing, the eccentric mounting of the pin rotor creating a close clearance on one side of the housing, between the pin tips and the housing interior surface, and a large clearance on the opposite side.

7. The contactor according to claim 6 wherein any fiber accretions are released from the pin tips into the rotating annulus of high consistency pulp proximate the large clearance.

8. The contactor according to claim 5 wherein the relief means comprises at least one closed chamber formed longitudinally in the interior surface of the housing.

9. The contactor according to claim 8 wherein the fiber accretions are released from the pin tips into the rotating annulus of high consistency pulp.

10. A high consistency pulp ozone bleaching contactor comprising:

a generally vertically oriented and conically shaped housing having an interior surface, a vertical axis, an inlet and an outlet, the outlet being axially separated from and lower than the inlet;

a means for introducing high consistency pulp into the housing;

a means for introducing a flow of ozone into the housing;

a combing means for combing high consistency pulp, for contacting the ozone with the high consistency pulp and for rotating the high consistency pulp about a vertical axis to form a rotating annulus of high consistency pulp adjacent the housing interior surface; and a relief means for limiting the build up of high consistency pulp fibers on the pin tips, wherein the relief means comprises the pin rotor being eccentrically mounted within the housing, the eccentric mounting of the pin rotor creating a close clearance on one side of the housing, between the pin tips and the housing interior surface, and a large clearance on the opposite side.

11. A high consistency pulp ozone bleaching contactor comprising:

a generally vertically oriented and conically shaped housing having an interior surface, a vertical axis, an inlet and an outlet, the outlet being axially separated from and lower than the inlet;

a means for introducing high consistency pulp into the housing;

a means for introducing a flow of ozone into the housing;

a combing means for combing high consistency pulp, for contacting the ozone with the high consistency pulp and for rotating the high consistency pulp about a vertical axis to form a rotating annulus of high consistency pulp adjacent the housing interior surface; and a relief means for limiting the build up of high consistency pulp fiber accretions on the pin tips wherein the relief means comprises at least one closed chamber formed longitudinally in the interior surface of the housing.

* * * * *